US011855391B2

(12) United States Patent
Chen et al.

(10) Patent No.: US 11,855,391 B2
(45) Date of Patent: Dec. 26, 2023

(54) HIGH SPEED ELECTRICAL CONNECTOR WITH REDUCED CROSSTALK

(71) Applicant: Dongguan Luxshare Technologies Co., Ltd, Dongguan (CN)

(72) Inventors: HongJi Chen, Dongguan (CN); HengShan Cheng, Dongguan (CN); YunFeng He, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 59 days.

(21) Appl. No.: 17/568,935

(22) Filed: Jan. 5, 2022

(65) Prior Publication Data

US 2022/0271477 A1 Aug. 25, 2022

(30) Foreign Application Priority Data

Feb. 19, 2021 (CN) ..... 202110189332.9

(51) Int. Cl.
*H01R 13/6471* (2011.01)
*H01R 13/6474* (2011.01)

(52) U.S. Cl.
CPC ..... *H01R 13/6471* (2013.01); *H01R 13/6474* (2013.01)

(58) Field of Classification Search
CPC ..... H01R 13/6461; H01R 13/658; H01R 13/6585; H01R 13/6591; H01R 13/6597; H01R 13/6474; H01R 13/6471; H01R 12/721; H01R 12/724; H01R 12/727; H01R 12/732; H01R 24/60
See application file for complete search history.

(56) References Cited

U.S. PATENT DOCUMENTS 7,867,031 B2 * 1/2011 Amleshi ..... H01R 13/6477 439/607.11
7,946,889 B2 5/2011 Mizumura
(Continued)

FOREIGN PATENT DOCUMENTS

CN 101015092 A 8/2007
CN 201350162 Y 11/2009
(Continued)

*Primary Examiner* — Marcus E Harcum
(74) *Attorney, Agent, or Firm* — Birch, Stewart, Kolasch & Birch, LLP

(57) ABSTRACT

An electrical connector comprising a terminal module, which comprises a ground terminal and a signal terminal disposed side by side with the ground terminal. The ground terminal comprises a first contacting part. The signal terminal comprises a second contacting part. An outer diameter of the first contacting part is greater than an outer diameter of the second contacting part. The contacting end of the ground terminal is wider than the contacting end of the signal terminal. By increasing the width of the contacting end of the ground terminal, the distance between the contacting end of the signal terminal and the contacting end of the adjacent ground terminal can be shortened. In this way, the return path for the signal terminal can be shorter, and more energy can be bound between the signal terminal and the ground terminal to avoid excessive interference from the surrounding magnetic field.

9 Claims, 6 Drawing Sheets

(56) References Cited

U.S. PATENT DOCUMENTS

| | | | | |
|---|---|---|---|---|
| 8,342,863 | B2 * | 1/2013 | Kondo | H01R 13/6471 439/108 |
| 8,550,855 | B2 | 10/2013 | Zhang et al. | |
| 9,972,945 | B1 * | 5/2018 | Huang | H01R 13/6585 |
| 10,431,934 | B2 * | 10/2019 | Toda | H01R 13/26 |
| 10,741,971 | B2 * | 8/2020 | Long | H01R 13/6471 |
| 11,251,558 | B1 * | 2/2022 | Lee | H01R 13/6599 |
| 11,251,569 | B2 * | 2/2022 | Liao | H01R 13/6471 |
| 11,398,693 | B2 * | 7/2022 | Yang | H01R 31/08 |
| 11,581,688 | B2 * | 2/2023 | Lin | H01R 13/6597 |
| 11,605,921 | B2 * | 3/2023 | Yang | H01R 13/6471 |
| 2008/0246555 | A1 * | 10/2008 | Kirk | H01R 13/514 333/125 |
| 2011/0189895 | A1 * | 8/2011 | Ito | H01R 12/721 439/629 |
| 2012/0184145 | A1 * | 7/2012 | Zeng | H01R 13/6585 439/626 |
| 2017/0018880 | A1 * | 1/2017 | Phillips | H01R 13/6585 |
| 2017/0125929 | A1 | 5/2017 | Fujii et al. | |
| 2017/0358885 | A1 * | 12/2017 | Okuyama | H01R 13/41 |
| 2018/0131145 | A1 * | 5/2018 | Zhao | H01R 13/6581 |
| 2019/0165518 | A1 * | 5/2019 | Hsu | H01R 13/6471 |
| 2019/0214755 | A1 * | 7/2019 | Manickam | H01R 12/721 |
| 2019/0372274 | A1 * | 12/2019 | Feng | H01R 13/46 |
| 2020/0076135 | A1 * | 3/2020 | Tang | H01R 12/724 |
| 2020/0099149 | A1 * | 3/2020 | Xu | H01R 13/6461 |
| 2020/0266584 | A1 | 8/2020 | Lu | |
| 2021/0091514 | A1 * | 3/2021 | Wu | H01R 13/115 |
| 2021/0159642 | A1 * | 5/2021 | Yang | H01R 13/6471 |
| 2021/0320448 | A1 * | 10/2021 | Chung | H01R 13/6471 |
| 2021/0328369 | A1 * | 10/2021 | Wu | H01R 13/6477 |
| 2022/0115816 | A1 * | 4/2022 | Huang | H01R 13/6594 |
| 2022/0158388 | A1 * | 5/2022 | Chung | H01R 13/6474 |

FOREIGN PATENT DOCUMENTS

| | | | | | |
|---|---|---|---|---|---|
| CN | 204947118 | U | | 1/2016 | |
| CN | 105703157 | A | * | 6/2016 | H01R 12/55 |
| CN | 207320484 | U | | 5/2018 | |
| CN | 207320485 | U | | 5/2018 | |
| CN | 108832339 | A | | 11/2018 | |
| CN | 208706931 | U | | 4/2019 | |
| CN | 209266612 | U | * | 8/2019 | |
| CN | 110867684 | A | | 3/2020 | |
| CN | 210350162 | U | | 4/2020 | |
| CN | 111244697 | A | | 6/2020 | |
| CN | 111262097 | A | | 6/2020 | |
| CN | 111370945 | A | | 7/2020 | |
| CN | 111512499 | A | | 8/2020 | |
| CN | 111525347 | A | | 8/2020 | |
| CN | 110311242 | B | * | 10/2020 | H01R 12/721 |
| CN | 212412345 | U | | 1/2021 | |
| CN | 212412347 | U | | 1/2021 | |
| TW | M584994 | U | | 10/2019 | |
| TW | M607468 | U | | 2/2021 | |
| WO | WO 03/026078 | A1 | | 3/2003 | |

* cited by examiner

HIGH SPEED ELECTRICAL CONNECTOR WITH REDUCED CROSSTALK

CROSS-REFERENCE TO RELATED APPLICATION

This application claims the priority benefit of Chinese Patent Application Serial Number 202110189332.9, filed on Feb. 19, 2021, the full disclosure of which is incorporated herein by reference.

BACKGROUND

Technical Field

The present disclosure relates to the technical field of connector, particularly to an electrical connector.

Related Art

In the prior arts, crosstalking is one of the critical issues to consider for designing electrical connectors, which is the coupling of two signal wires since the spatial distance between the two signal wires is too close, leading to inductive and capacitive coupling among signal wires and interferences thereby. Capacitive coupling causes coupling current, while inductive coupling causes coupling voltage. Crosstalking is a type of interference energy value caused by the coupling of one signal to another signal, which could affect the high-speed transmission of data. The source of crosstalking is the interference between magnetic fields generated by electric current. Inductive signals may cause loss of data transmission and transmission errors. Thus, dealing with crosstalking effectively is one of the main issues to be considered for electrical connector designing.

SUMMARY

The embodiments of the present disclosure provide an electrical connector tended to solve the problem of crosstalking among signal terminals of conventional electrical connectors.

The present disclosure provides an electrical connector comprising a terminal module. The terminal module comprises a ground terminal and a signal terminal disposed side by side with the ground terminal. The ground terminal comprises a first contacting part. The signal terminal comprises a second contacting part. An outer diameter of the first contacting part is greater than an outer diameter of the second contacting part.

In the embodiments of the present disclosure, by increasing the outer diameter of the first contacting part of the ground terminal to be greater than the outer diameter of the second contacting part of the signal terminal, the outer diameter of the first contacting part of the ground terminal can be increased to shorten the distance between the second contacting part of the signal terminal and the first contacting part of the adjacent ground terminal. In this way, the return path for the signal terminal can be shorter, and more energy can be bound between the signal terminal and the ground terminal to avoid excessive interference from the surrounding magnetic field. Thus, the crosstalking among signal terminals can be effectively handled.

In one embodiment, the number of the ground terminals is multiple. The number of the signal terminals is multiple. Every two of the plurality of signal terminals are disposed between every two of the plurality of ground terminals. A gap distance between the first contacting part and the second contacting part adjacent to the first contacting part is different from a gap distance between two adjacent second contacting parts.

In one embodiment, the gap distance between the first contacting part and the second contacting part adjacent to the first contacting part is smaller than the gap distance between two adjacent second contacting parts.

In one embodiment, the number of the ground terminals is plural. The number of the signal terminals is plural. Every two of the plurality of signal terminals are disposed between every two of the plurality of ground terminals. The ground terminal comprises a first body part. The first contacting part extends outward from one end of the first body part. The signal terminal comprises a second body part. The second contacting part extends outward from one end of the second body part. Wherein a gap distance between the first body part and the second body part adjacent to the first body part is equal to a gap distance between two adjacent second body parts.

In one embodiment, an orifice is provided at the center of the first body part.

In one embodiment, an insulating member is further provided. The first body parts of the plurality of ground terminals and the second body parts of the plurality of signal terminals are disposed in the insulating member.

In one embodiment, the insulating member comprises a plurality of first orifices. The first body parts of the plurality of ground terminals are exposed from the plurality of first orifices.

In one embodiment, a metal member disposed at the insulating member is further provided. The metal members are respectively connected to the first body parts of the plurality of ground terminals through the plurality of first orifices.

In one embodiment, a housing covering the insulating member and the metal member is further provided.

In one embodiment, the insulating member comprises a plurality of second orifices from which the second body parts of the plurality of signal terminals are exposed.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
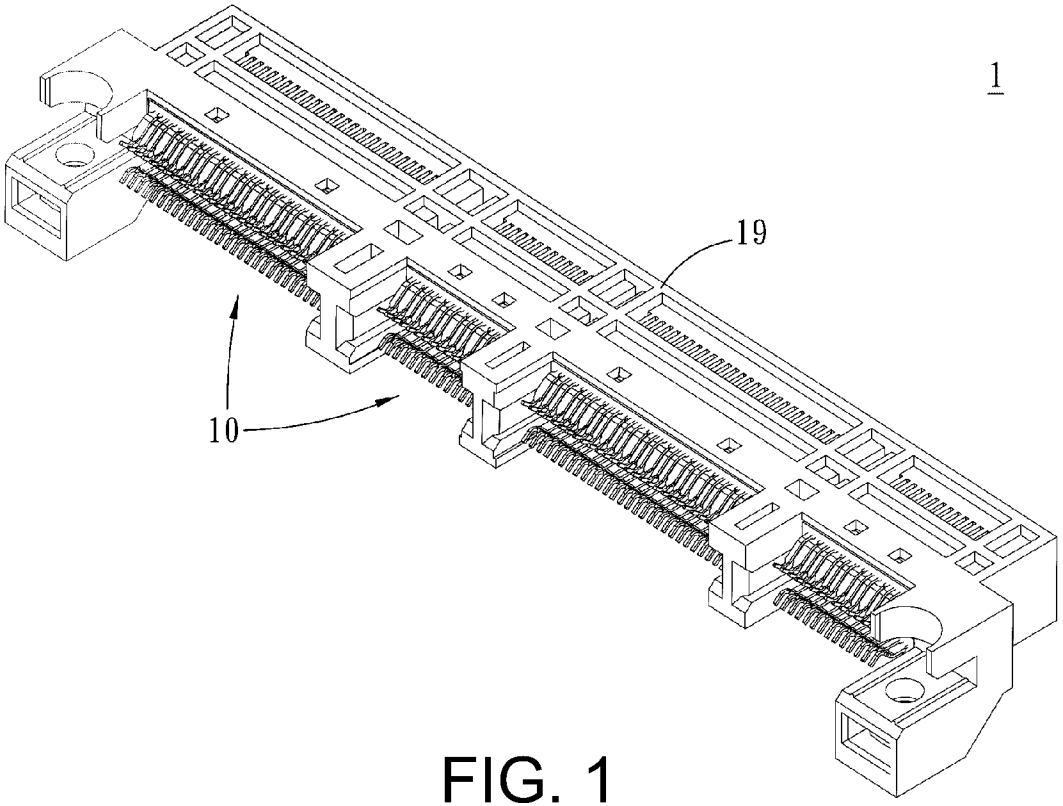
FIG. 1 is a perspective view of an electrical connector of the present disclosure.
Figure 2:
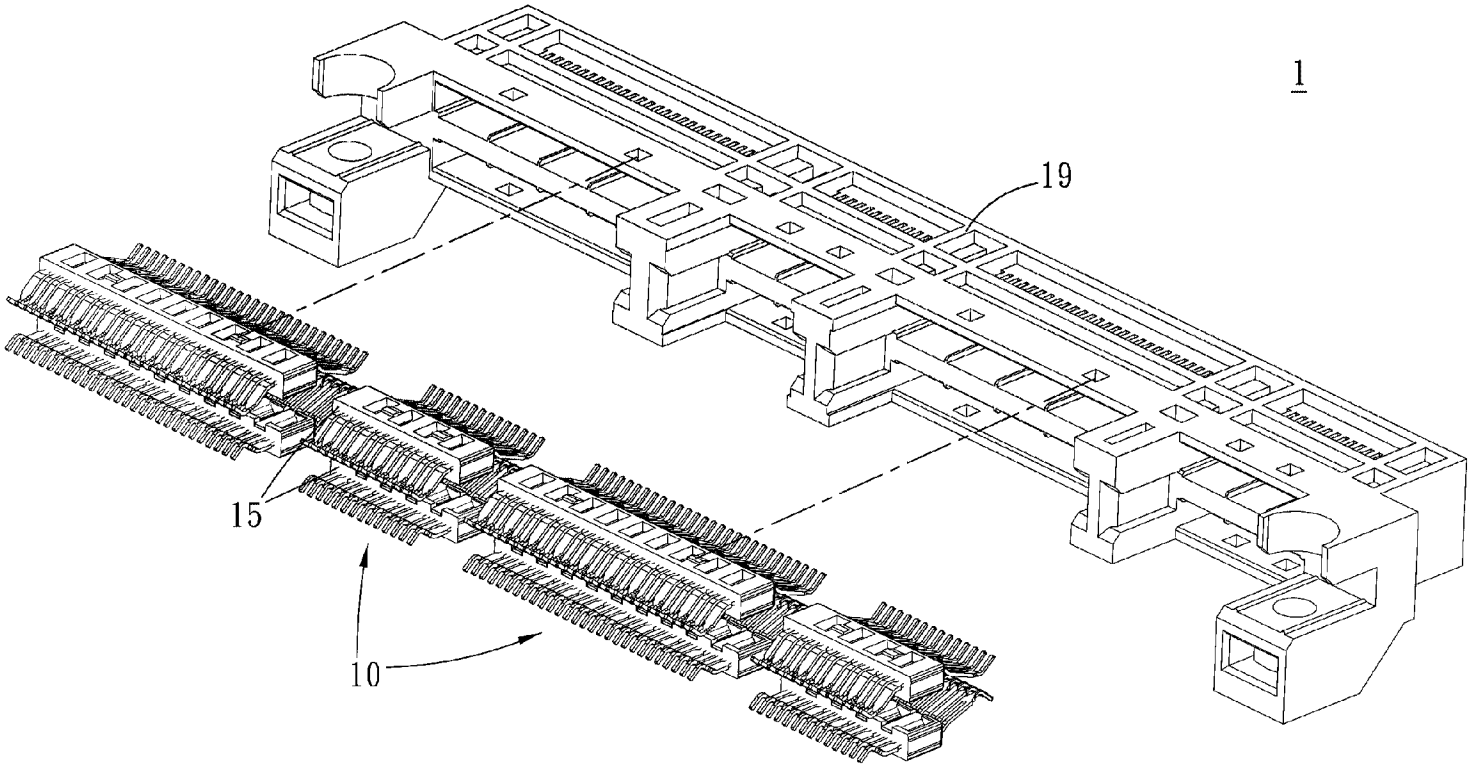
FIG. 2 is an exploded view of an electrical connector of the present disclosure.
Figure 3:
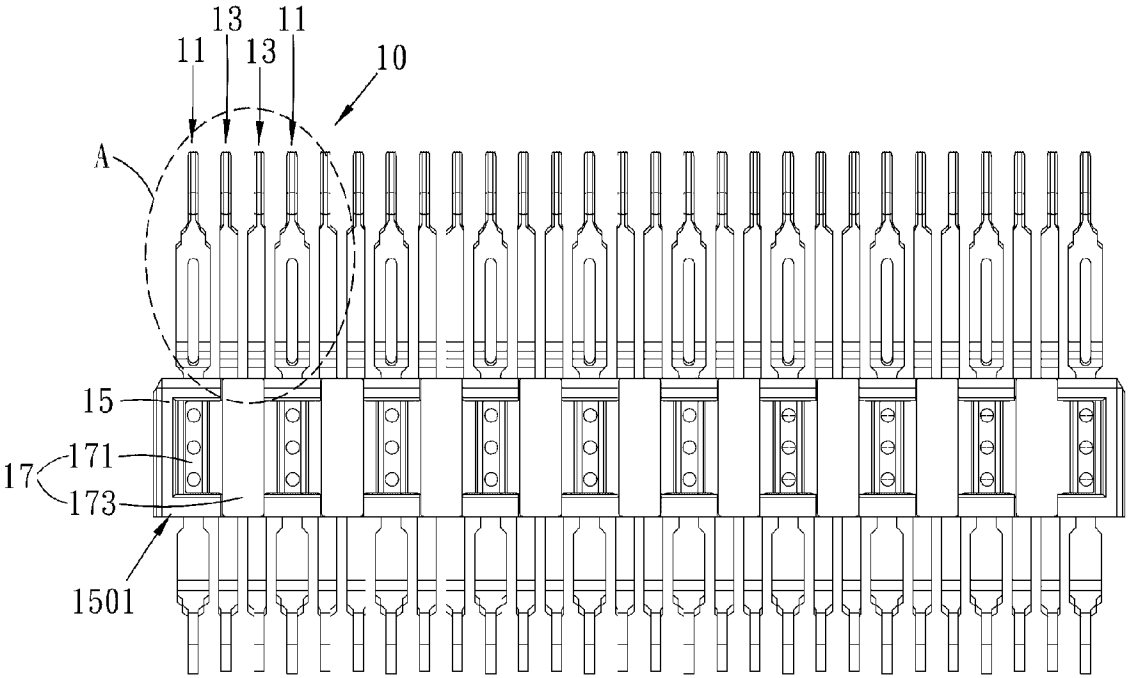
FIG. 3 is a schematic diagram of a terminal module of the electrical connector of the present disclosure.
Figure 4:
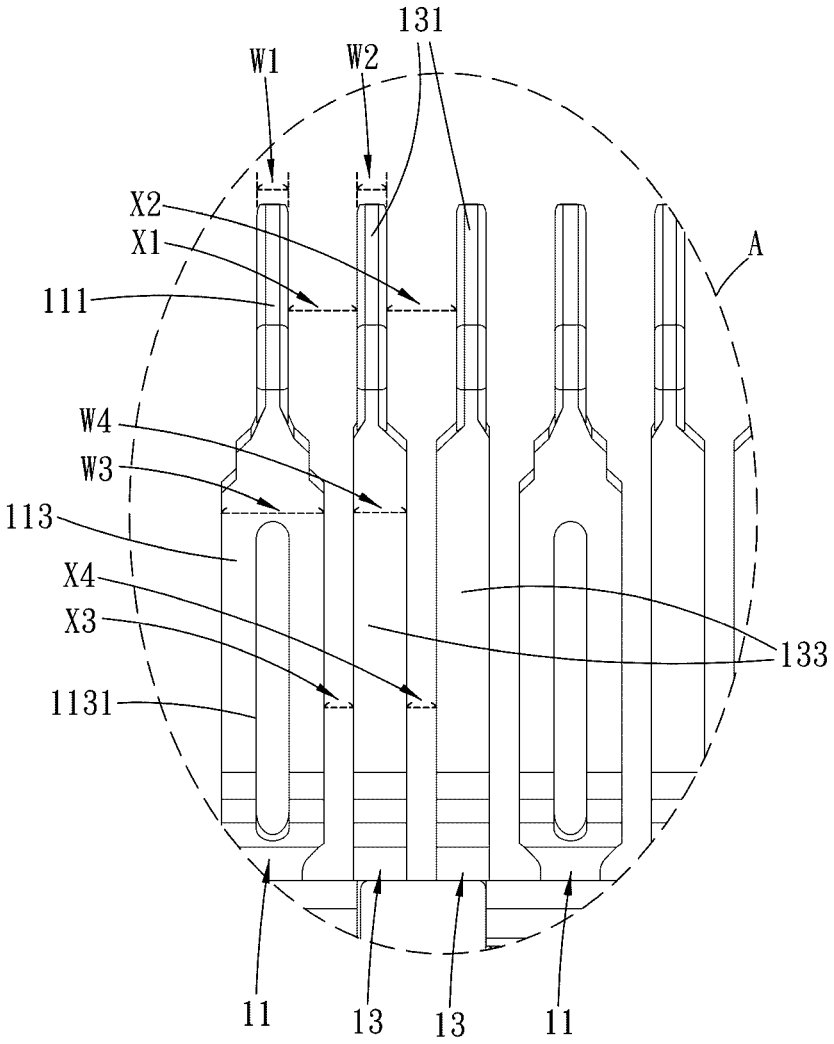
FIG. 4 is an enlarged view of area A of FIG. 3.

FIG. 1 is a perspective view and FIG. 2 is an exploded view of an electrical connector of the present disclosure. FIG. 3 is a schematic diagram of a terminal module of the electrical connector of the present disclosure. FIG. 4 is an enlarged view of area A of FIG. 3. As shown in the figures, this embodiment provides an electrical connector 1, which can be used for high-speed data or signal transmission and can be applied to Gen Z connectors. In this embodiment, the electrical connector 1 comprises a terminal module 10. The terminal module 10 comprises a ground terminal 11 and a signal terminal 13 disposed side by side with the ground terminal 11. The ground terminal 11 comprises a first contacting part 111, and the signal terminal 13 comprises a second contacting part 131. An outer diameter W1 of the first contacting part 111 is greater than an outer diameter W2 of the second contacting part 131. In this embodiment, the ground terminal 11 is widened while the signal terminal 13 is narrowed. In this way, the transmission rate of the electrical connector 1 can be further improved, and the resonance and crosstalking during the signal transmission process can also be improved.

Referring to FIG. 0.4, in this embodiment, the number of ground terminals 11 is multiple and the number of signal terminals 13 is multiple. The ground terminal 11 and the signal terminal 13 are alternately disposed. For example, every two of the plurality of signal terminals 13 are disposed between every two of the plurality of ground terminals 11. The method is first to dispose one ground terminal 11, followed by connecting the two signal terminals 13 side by side, and then repeat the procedure of disposing one ground terminal 11 then the connection of the two signal terminals 13 side by side, and finally the terminal module 10 can be formed by repeating the arrangement according to the above method. Wherein a gap distance X1 between the first contacting part 111 of the ground terminal 11 and the second contacting part 131 of the signal terminal 13 adjacent to the first contacting part 111 is different from a gap distance X2 between two adjacent second contacting parts 131. Furthermore, the gap distance X1 between the first contacting part 111 and the second contacting part 131 adjacent to the first contacting part 111 is smaller than the gap distance X2 between two adjacent second contacting parts 131.

In this embodiment, when the ground terminal 11 and the signal terminal 13 of the terminal module 10 transmit signals, an electric field line would be generated between the signal path and the return path. Magnetic field lines (magnetic fields) would surround the terminals of the signal path and return path. The magnetic field lines are not enclosed in the space between the signal path and the return path but would extend to the surrounding space. When the voltage of the terminal module 10 alters rapidly, the magnetic field lines would generate an induced voltage to the adjacent terminal module 10 as crosstalk. However, in this embodiment, by shortening the distance between the ground terminal 11 and the signal terminal 13, the return path of the signal can be shortened, and the range of the electric field lines can be relatively reduced. In this way, the probability that the magnetic field lines could affect the electric field lines is reduced, thereby reducing the crosstalking.

Besides, the ground terminal 11 comprises a first body part 113. The first contacting part 111 of the ground terminal 11 extends outward from one end of the first body part 113. The signal terminal 13 comprises a second body part 133. The second contacting part 131 of the signal terminal 13 extends outward from one end of the second body part 133. An outer diameter W3 of the first body part 113 is greater than an outer diameter W4 of the second body part 133. In addition, the distance X3 between the first body part 113 and the second body part 133 adjacent to the first body part 113 is equal to the distance X4 between two adjacent second body parts 133.

Moreover, the first body part 113 of the ground terminal 11 is widened. An orifice 1131 is provided at the center of the first body part 113 of the ground terminal 11. When the electrical connector is inserted into a corresponding electrical connector, the ground terminal 11 of the electrical connector would abut against the terminal of the corresponding electrical connector. At this time, the orifice 1131 of the ground terminal 11 can disperse the abutting force to avoid the force concentrated on the ground terminal 11 and avoid structural deformation of the ground terminal 11.

Figure 5:
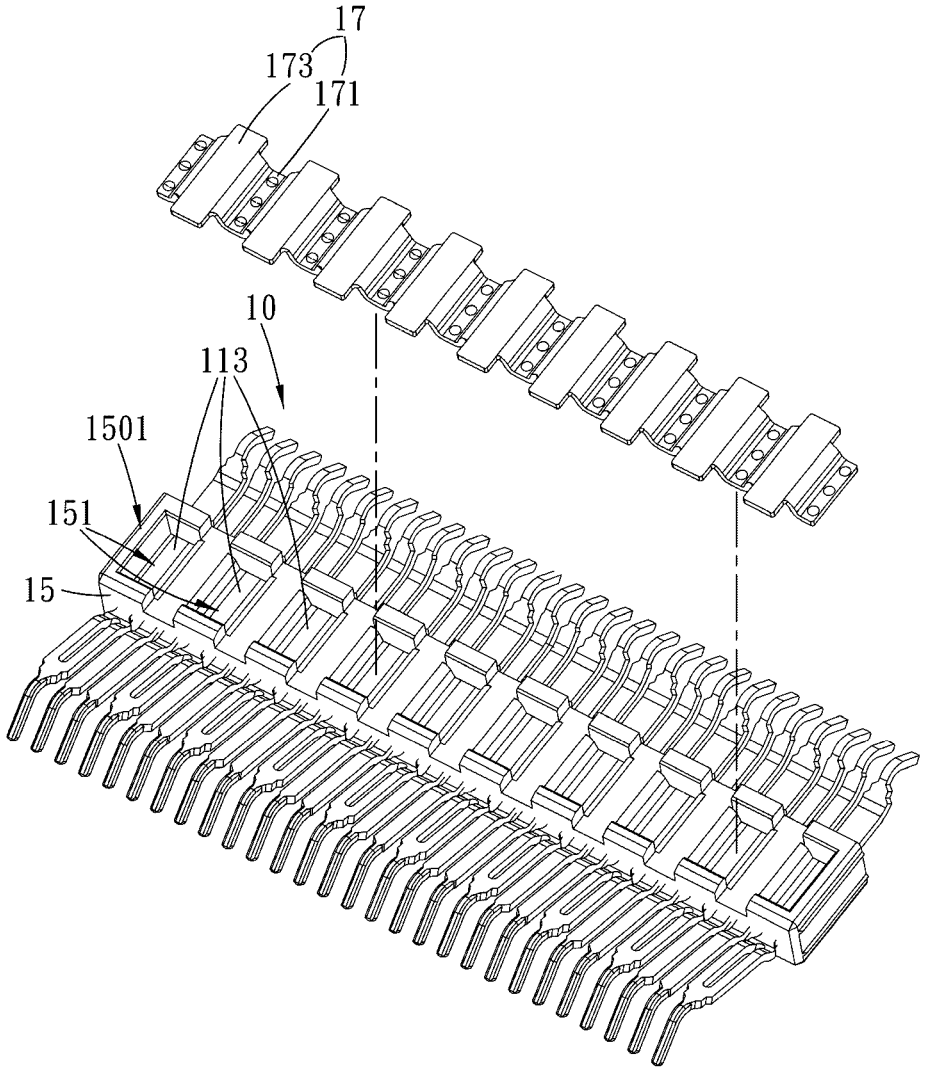
FIG. 5 is an exploded view of the terminal module of the electrical connector of the present disclosure.

FIG. 5 is an exploded view of the terminal module of the electrical connector of the present disclosure. As shown in the figure, in this embodiment, the electrical connector 1 further comprises an insulating member 15 in which the first body part 113 and the second body part 133 are disposed. That is, the insulating member 15 covers the first body part 113 of the plurality of ground terminals 11 and the second body part 133 of the plurality of signal terminals 13. Wherein, a first surface 1501 of the insulating member 15 comprises a plurality of first orifices 151 from which the first body parts 113 of the plurality of ground terminals 11 in the insulating member 15 are exposed.

The electrical connector 1 further comprises a metal member 17 disposed on the first surface 1501 of the insulating member 15. The metal members 17 are respectively connected to the first body parts 113 of the plurality of ground terminals 11 through the plurality of first orifices 151. The metal member 17 is wave-shaped. The metal member 17 comprises a plurality of securing parts 171 and a plurality of connecting parts 173. The plurality of securing parts 171 and a plurality of connecting parts 173 are alternately arranged in sequence. That is, the connecting part 173 is disposed between two securing parts 171, and the securing part 171 is disposed between the two connecting parts 173. The plurality of securing parts 171 of the metal member 17 are disposed in the plurality of first orifices 151, and the plurality of securing parts 171 are connected to the plurality of first body parts 113. The plurality of securing parts 171 of the metal member 17 can be laser welded, resistance welded, or ultrasonic welded to the first body part 113 of the plurality of grounding terminals 116 to realize the electrical connector 1 having excellent electrical reliability.

Figure 6:
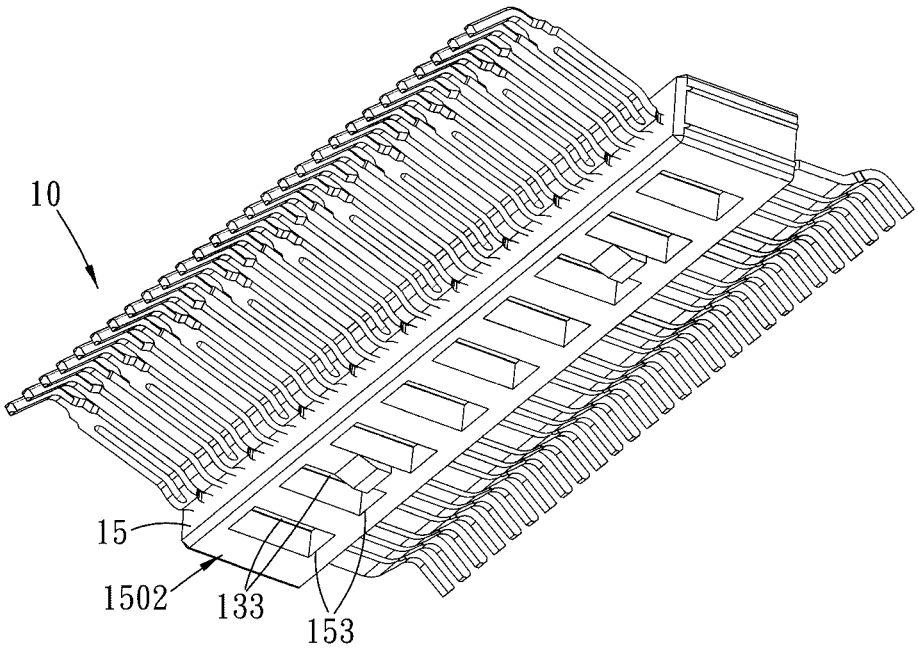
FIG. 6 is a perspective view of the terminal module of the electrical connector of the present disclosure.

FIG. 6 is a perspective view of the terminal module of the electrical connector of the present disclosure. As shown in the figure, in this embodiment, a second surface 1502 of the insulating member 15 opposite to the first surface 1501 comprises a plurality of second orifices 153. The first surface 1501 and the second surface 1502 are opposite surfaces of the insulating member 15. The second body parts 133 of the plurality of signal terminals 13 are exposed from the plurality of second orifices 153. In this embodiment, a plurality of signal terminals 13 can be exposed through the insulating member 15, allowing the air to be a part of the transmission medium to stabilize the signal transmission.

Referring to FIG. 1, in this embodiment, the electrical connector 1 further comprises a housing 19 covering and securing the insulating member 15 and the metal member 17. After the two terminal modules 10 are oppositely disposed, the insulating member 15 and the metal member 17 are sequentially disposed at the terminal module 10, and then the two terminal modules 10 are oppositely assembled in the housing 19.

In summary, embodiments of the present disclosure provide an electrical connector. By increasing the outer diameter of the first contacting part of the ground terminal to be greater than the outer diameter of the second contacting part of the signal terminal, the width of the contacting end of the ground terminal can be increased to shorten the distance between the contacting end of the signal terminal and the contacting end of the adjacent ground terminal. In this way, the return path for the signal terminal can be shorter, and more energy can be bound between the signal terminal and the ground terminal to avoid excessive interference from the surrounding magnetic field. Thus, the crosstalking among signal terminals can be effectively handled.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a terminal module comprising a ground terminal and a signal terminal disposed side by side with the ground terminal, the ground terminal comprising a first contacting part, the signal terminal comprising a second contacting part, an outer diameter of the first contacting part is greater than an outer diameter of the second contacting part;

wherein the number of the ground terminals is plural; the number of the signal terminals is plural; every two of the plurality of signal terminals are disposed between every two of the plurality of ground terminals; the ground terminal comprises a first body part; the first contacting part extends outward from one end of the first body part; the signal terminal comprises a second body part; the second contacting part extends outward from one end of the second body part; wherein a gap distance between the first body part and the second body part adjacent to the first body part is equal to a gap distance between two adjacent second body parts.

2. The electrical connector according to claim 1, wherein a gap distance between the first contacting part and the second contacting part adjacent to the first contacting part is different from a gap distance between two adjacent second contacting parts.

3. The electrical connector according to claim 2, wherein the gap distance between the first contacting part and the second contacting part adjacent to the first contacting part is smaller than the gap distance between two adjacent second contacting parts.

4. The electrical connector according to claim 1, wherein an orifice is provided at the center of the first body part.

5. The electrical connector according to claim 1 comprising an insulating member, the first body parts of the plurality of ground terminals and the second body parts of the plurality of signal terminals being disposed in the insulating member.

6. The electrical connector according to claim 5, wherein the insulating member comprises a plurality of first orifices; the first body parts of the plurality of ground terminals are exposed from the plurality of first orifices.

7. The electrical connector according to claim 6 comprising a metal member disposed at the insulating member, the metal members being respectively connected to the first body parts of the plurality of ground terminals through the plurality of first orifices.

8. The electrical connector according to claim 7 comprising a housing covering the insulating member and the metal member.

9. The electrical connector according to claim 5, wherein the insulating member comprises a plurality of second orifices from which the second body parts of the plurality of signal terminals are exposed.

* * * * *